United States Patent [19]

Durand

[11] Patent Number: 5,040,344

[45] Date of Patent: Aug. 20, 1991

[54] PREFABRICATED FORMS FOR CONCRETE WALLS

[76] Inventor: Philippe Durand, 3, Allée de la Rive, 78740 Vaux sur Seine, France

[21] Appl. No.: 531,294

[22] Filed: May 31, 1990

[30] Foreign Application Priority Data

May 31, 1989 [FR] France ..... 89 07149

[51] Int. Cl.[5] ..... E04C 2/26; E04B 2/44; E04B 2/26

[52] U.S. Cl. ..... 52/127.2; 52/309.12; 52/426

[58] Field of Search ..... 52/127.2, 309.12, 426; 249/38, 36, 34, 45, 43

[56] References Cited

U.S. PATENT DOCUMENTS

| | | | |
|---|---|---|---|
| 1,486,499 | 3/1924 | Taylor | 249/38 |
| 1,970,547 | 8/1934 | Anderson | 249/45 |
| 2,511,584 | 6/1950 | Hill | 248/34 |
| 2,859,503 | 11/1958 | Hennig | 249/45 |
| 2,989,794 | 6/1961 | Bittner | 249/46 |
| 4,085,495 | 4/1978 | Hebert | 249/45 |
| 4,516,372 | 5/1985 | Grutsch | 52/309.12 |
| 4,604,843 | 8/1986 | Ott | 52/309.12 |
| 4,791,767 | 12/1988 | Boeshart | 52/309.12 |
| 4,888,931 | 12/1989 | Meilleur | 52/426 |
| 4,924,641 | 5/1990 | Gibbar | 52/309.12 |

FOREIGN PATENT DOCUMENTS

| | | | |
|---|---|---|---|
| 2041991 | 3/1972 | Fed. Rep. of Germany . | |
| 2255810 | 5/1974 | Fed. Rep. of Germany . | |
| 1544405 | 10/1968 | France . | |
| 2548716 | 1/1985 | France . | |
| 407071 | 8/1944 | Italy | 249/45 |

*Primary Examiner*—John E. Murtagh
*Attorney, Agent, or Firm*—Young & Thompson

[57] ABSTRACT

Prefabricated formwork elements for the construction of external walls of buildings comprise at least one pair of panels (1, 2) of heat-insulating material which are intended to be maintained in parallel relation in order to delimit between them a space (3) which is intended to be filled with concrete, each panel (1, 2) being reinforced by horizontal stiffeners (4) and shores (5) being provided for maintaining the two panels in a vertical position and in spaced relation. The shores (5) are removably attached to the horizontal stiffeners (4) of one (2) of the panels, the panels being maintained in spaced relation by connecting the stiffeners (4) of one of the panels to the stiffeners of the other panel.

1 Claim, 3 Drawing Sheets

PREFABRICATED FORMS FOR CONCRETE WALLS

BACKGROUND OF THE INVENTION

1. Field of the Invention

The present invention relates to prefabricated formwork elements for the construction of external walls of buildings.

The invention is also directed to the method of construction of a wall which makes use of these elements.

2. Description of the Prior Art

Known prefabricated formwork elements are described in French patent No. 2,548,716 granted to the present Applicant and comprise a pair of panels of heat-insulating material, one of which is an inner panel whilst the other is an outer panel. These panels are intended to be maintained parallel to each other so as to delimit between them a space which is intended to be filled with concrete, each panel being reinforced by horizontal stiffeners and shores external to the panels being provided for maintaining the two panels in a vertical position and in spaced relation.

In this French patent, the two panels are placed on each side of vertical metal poles to which they are attached.

Moreover, the shores which serve to maintain the vertical panels while concrete is being poured between them and until the concrete has set are secured to the aforementioned vertical poles placed between the two panels.

The use and positioning of the aforementioned poles complicates and increases the cost of construction of the wall. The present Applicant has consequently made researches with a view to eliminating these poles.

The object of the present invention is therefore to dispense with the poles used in the prior art.

SUMMARY OF THE INVENTION

The invention is thus directed to prefabricated formwork elements for the construction of external walls of buildings, comprising a pair of panels of heat-insulating material which are constituted by an inner panel and an outer panel and are intended to be maintained in parallel relation so as to delimit between them a space which is intended to be filled with concrete, each panel being reinforced by horizontal stiffeners and shores external to the panels being provided for maintaining the two panels in a vertical position and in spaced relation.

In accordance with the invention, the prefabricated formwork elements are distinguished by the fact that means are provided for removably attaching shores to the horizontal stiffeners of one of the panels and that other means are provided for connecting the stiffeners of one of the panels to the stiffeners of the other panel and maintaining these latter in spaced relation.

In view of the fact that the shores are connected to the stiffeners of one of the panels and that the stiffeners of said panels are connected to each other, the two panels are rigidly fixed to the external shores, with the result that the presence of metal poles between these panels no longer serves any purpose.

Positioning of the prefabricated elements in accordance with the present invention is thus less complicated and costly than in the case of those described in French patent No. 2,548,716.

In an advantageous embodiment of the present invention, the stiffeners each have a portion which projects from the inner panel face and is provided with openings, the stiffeners of the two panels being connected to each other and maintained in spaced relation by means of rods provided at their opposite ends with hooks engaged in the openings aforesaid.

Said hooked rods thus secure the two panels in rigidly fixed relation while maintaining them at the requisite distance. Said rods withstand the pressure exerted by the concrete which is being poured between the two panels and tends to separate them.

In a preferred embodiment of the invention, the shores are removably attached to the stiffeners of one of the panels by means of hooks which pass through this latter.

Said hooks thus make the panels integral with the shores. Moreover, the shores can readily be removed after setting of the concrete.

According to another aspect of the present invention, the method of construction of a wall involving the use of the elements aforesaid is distinguished by the following steps:

- the shores are fixed vertically on the slab which is intended to support the wall to be constructed, along the perimeter corresponding to the inner face of said wall,
- the elements of the outer panel are placed on top of each other and these elements are temporarily attached to the shores by means of suitable ties which connect the stiffeners of said elements to the shores,
- the elements of the inner panel are placed parallel to the outer panel which is already in position and said elements are attached to the shores by means of suitable ties,
- the stiffeners of both panels are connected to each other by means of hooked rods engaged in the holes of the projecting portions of the stiffeners,
- concrete is poured into the space located between the two panels,
- the shores are removed after setting of the concrete.

This method is very easy and inexpensive to apply, in particular because it does not entail the need to position metal poles between the two panels.

DETAILED DESCRIPTION OF THE INVENTION

Figure 1:
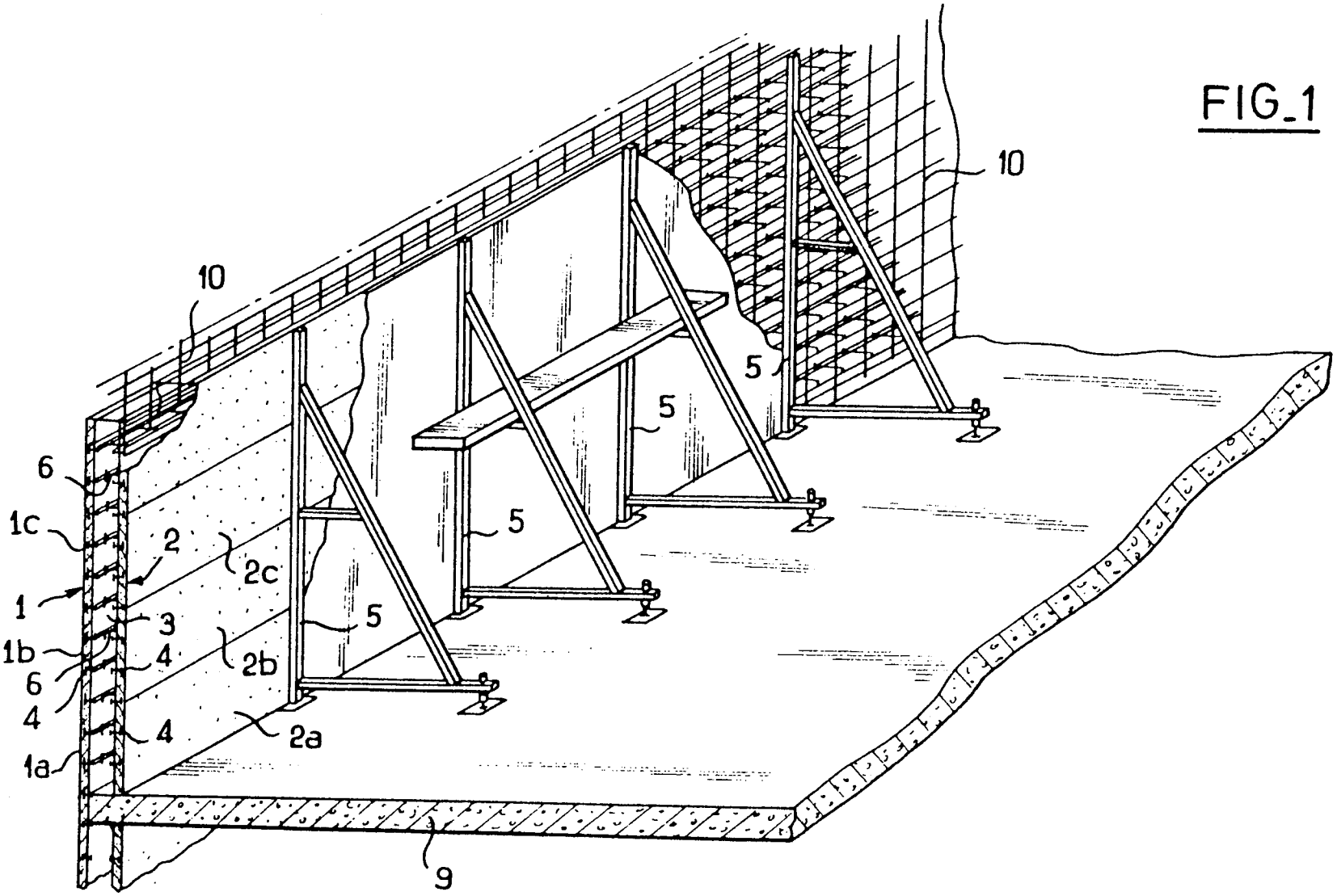
FIG. 1 is a cutaway view in perspective of formwork in accordance with the invention.

In the embodiment of the accompanying figures, the formwork for the construction of external walls of buildings comprises a pair of panels 1, 2 of heat insulating material such as expanded polystyrene or polyurethane, one panel 2 being an inner panel and the other panel 1 being an outer panel, said panels being maintained in parallel relation so as to delimit between them a space 3 which is intended to be filled with concrete. Each panel 1, 2 is reinforced by horizontal stiffeners 4. Vertical shores 5 external to the panels 1, 2 are provided for maintaining the two panels 1, 2 in a vertical position and in spaced relation.

In accordance with the invention, means are provided for removably attaching the shores 5 to the horizontal stiffeners 4 of one of the panels 1, 2 and other means are provided for connecting the stiffeners 4 of one of the panels 1, 2 to the stiffeners 4 of the other panel and for maintaining these latter in spaced relation.

Figure 2:
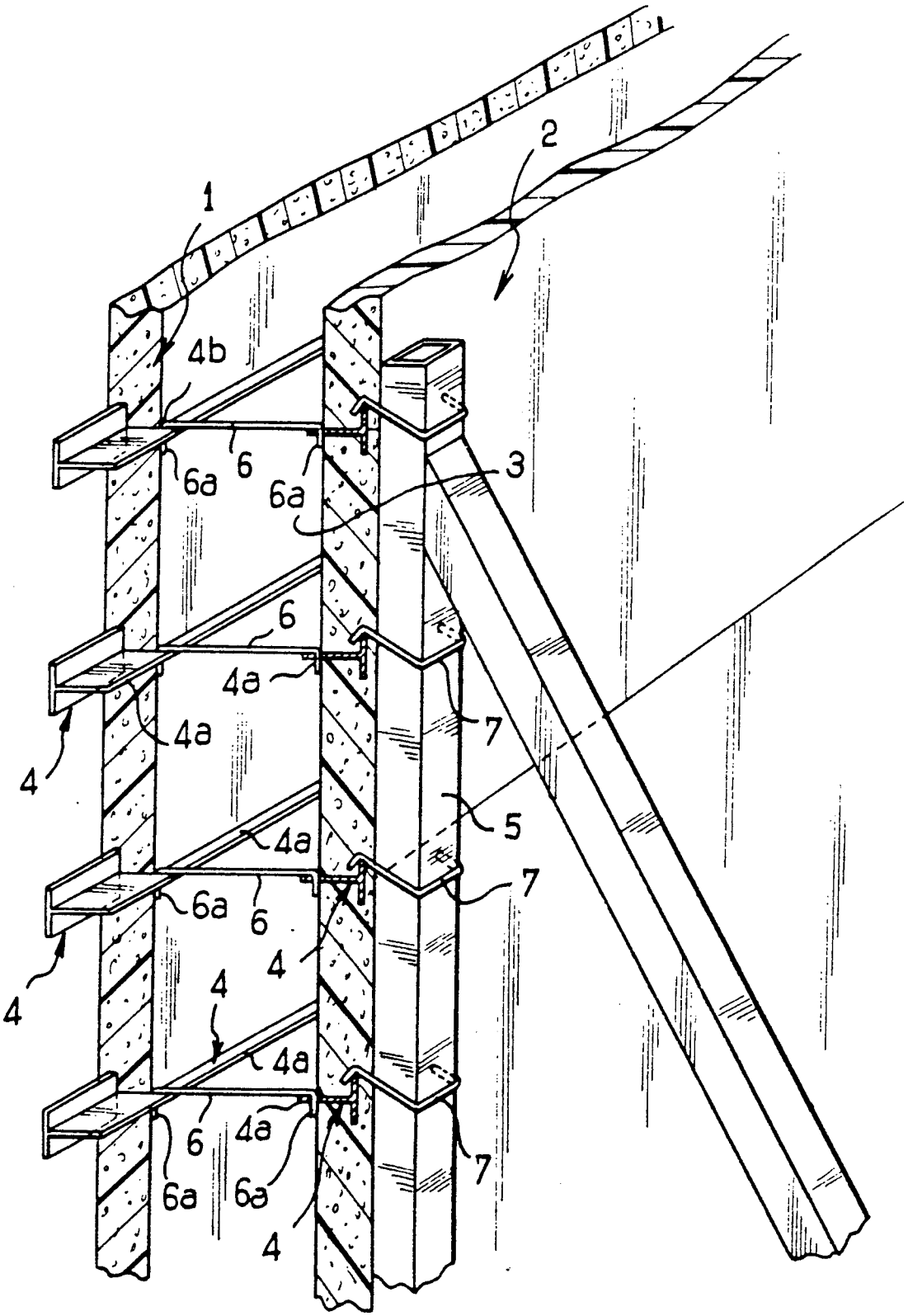
FIG. 2 is a view in perspective to a larger scale showing part of the formwork.

As shown in particular in FIG. 2, the stiffeners 4 each have a portion 4*a* which projects from the inner faces of the panels 1, 2. This portion 4*a* has openings 4*b*. Rods 6 provided at their opposite ends with hooks 6*a* engaged in the openings 4*b* serve to interconnect the stiffeners 4 of the two panels 1, 2 and maintain them at a distance from each other.

Figure 3:
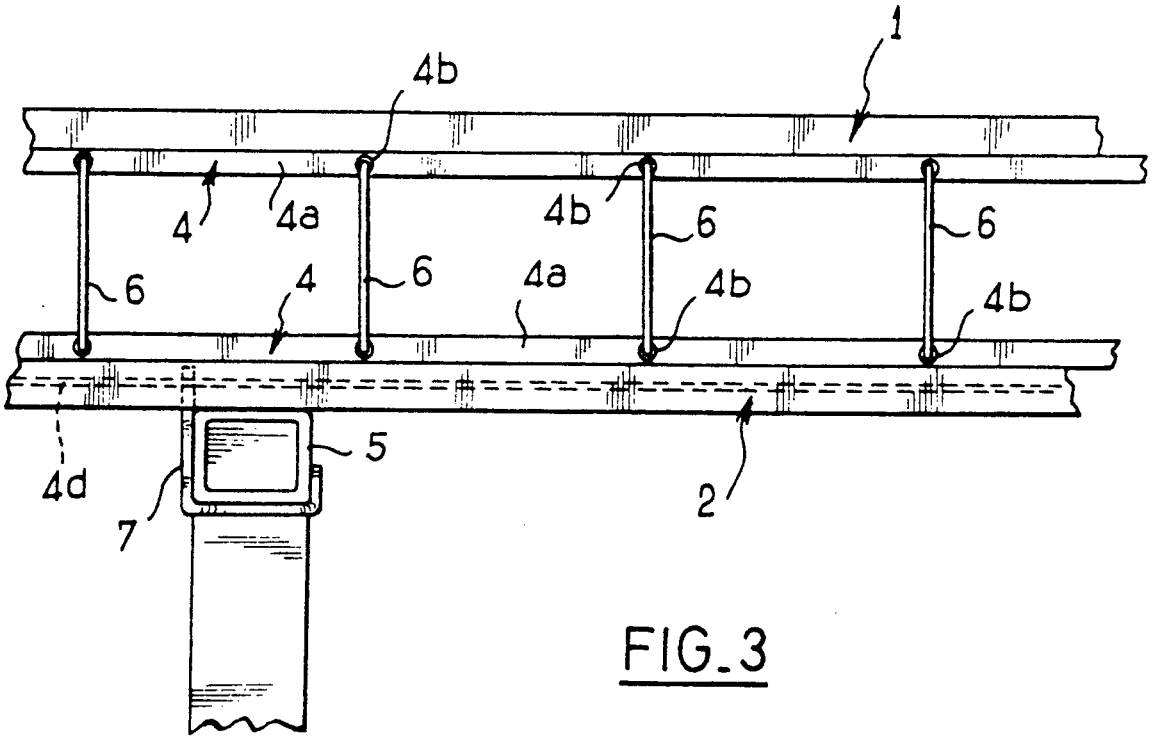
FIG. 3 is a top view of the formwork.
Figure 4:
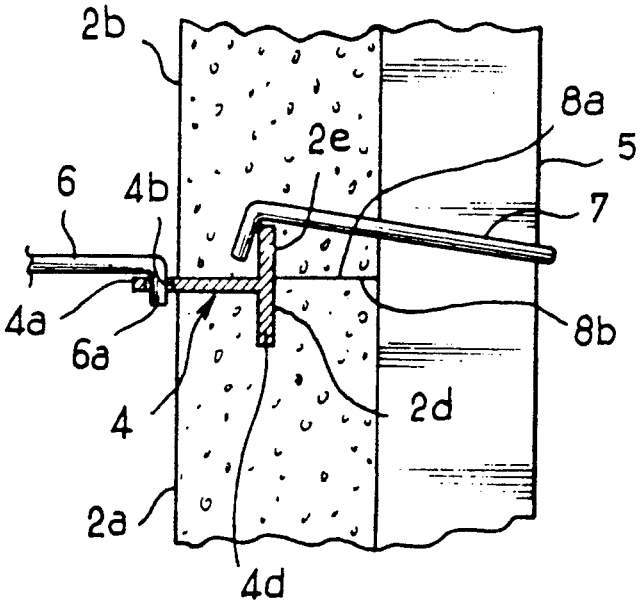
FIG. 4 is a fragmentary view of a panel showing a stiffener at the interface between two panel elements and a rod attached to the stiffener.

Moreover, the shores 5 are removably attached to the stiffeners 4 of one of the panels, namely the inner panel 2, by means of hooks 7 which pass through this latter (as shown in FIGS. 2, 3 and 4).

In fact, in the example illustrated, the shores 5 are placed on the outer face of the panel 2 which is adjacent to the inside of the wall.

Moreover, in the example shown, each panel 1, 2 is constituted by a plurality of superposed panel elements 1*a*, 1*b*, 1*c*, . . . ; 2*a*, 2*b*, 2*c*, . . . .

Furthermore, means are provided for carrying out accurate centering of the adjacent edges of the superposed panel elements. In the example which is illustrated, said means are constituted by T-section stiffeners 4 (as shown in particular in FIG. 4) which extend between the adjacent edges of the panel elements 1*a*, 1*b*, 1*c*, . . . ; 2*a*, 2*b*, 2*c*, . . . . One wing 4*d* of the T is engaged in two vertical grooves 2*d*, 2*e* formed in the edges 8*a*, 8*b* of two adjacent panel elements (such as the elements 2*a*, 2*b* in FIG. 4) and the other wing 4*a* of the T extends between the two edges 8*a*, 8*b* and projects from the inner face of the two panel elements.

In order to construct a wall by means of the formwork elements which have just been described, the procedure is as follows.

In a first step, the shores 5 are fixed vertically on the slab 9 (see FIG. 1) which is intended to support the wall to be constructed, along the perimeter which corresponds to the inner face of said wall.

In a second step, the elements 1*a*, 1*b*, 1*c*, . . . of the outer panel 1 are placed on top of each other and these elements are temporarily attached to the shores 5 by means of suitable ties which connect the stiffeners 4 of said elements to the shores.

During this step, accurate positioning of the elements 1*a*, 1 *b*, 1*c*, . . . on top of each other is made possible by means of the stiffeners 4 which are already in position within a groove formed in the edge of the lower element and by the fact that the edge of the upper element has a groove which engages over the projecting vertical wing of the stiffener 4 of the lower element.

In a third step, the elements 2*a*, 2*b*, 2*c*, . . . of the inner panel 2 are placed parallel to the outer panel 1 which is already in position and these elements are attached to the shores 5 by means of the hooks 7, the end portions 7*a* of said hooks being engaged on the vertical wing of the stiffeners 4 (as shown in FIG. 4).

In a fourth step, the stiffeners 4 of the two panels 1, 2 are connected to each other by means of hooked rods 6 engaged in the holes 4*b* of the projecting portions 4*a* of the stiffeners 4.

In a fifth step, concrete is poured into the space 3 located between the two panels 1, 2 and the shores 5 are removed after setting of the concrete.

In order to reinforce the wall structure, one or a number of wire-mesh elements 10 can be placed within the space 3 which is intended to receive the concrete (as indicated in FIG. 1) before positioning of the second panel.

The main advantages of the invention are as follows.

The practical application of the invention is achieved by means of inexpensive and lightweight members such as the hooked rods 6 and the hooks 7.

The only relatively heavy members are the shores 5 but these latter are recovered on completion of operations.

In comparison with the method described in French patent No. 2,548,716 granted to the present Applicant, the present invention has an advantage in that it does not call for the use of metal poles which are placed vertically between the panels 1 and 2 so as to connect these latter to each other as well as to the external shores. In fact, tests have shown that the external shores were sufficient to withstand the pressure exerted by the concrete as it is poured into the space 3, taking into account the fact that the panels 1 and 2 are connected to each other by means of hooked rods 6 which maintain the spacing between the two panels.

As will be readily apparent, the invention is not limited to the example of construction which has just been described and a large number of modifications can be contemplated without thereby departing from the scope or the spirit of the invention.

What is claimed is:

1. A concrete-wall formwork comprising a pair of side-walls each formed by a plurality of superposed panels (1, 2) having adjacent edges (8*a*, 8*b*), said panels being made of expanded plastic material, each panel having an inner face and an outer face, each panel (1, 2) being reinforced by horizontal stiffeners (4) having each a vertical and a horizontal wing defining a T-section, the vertical wings (4*d*) of the T being engaged within two vertical grooves (2*a*, 2*d*) formed in the edges of two adjacent panel elements whilst the horizontal wing (4*a*) of the T extends between the two edges (8*a*, 8*b*) and projects form the inner face of the two panels, said horizontal wing (4*a*) being provided with openings (4*b*), and rods (6) provided at the opposite ends thereof with hooks engaged in said openings (4*b*), said rods connecting the stiffeners (4) of both panels to each other and maintain said panels in spaced relation, and shores (5) external to the panels maintaining the two panels in a vertical position and in spaced relation, said shores (5) being removably attached to said stiffeners (4) of one (2) of the panels by means of hooks (7) which pass through said one panel and have an end portion (7*a*) anchored to the vertical wing (4*d*)of each stiffener (4).

* * * * *